US008376599B2

(12) United States Patent
Stade et al.

(10) Patent No.: US 8,376,599 B2
(45) Date of Patent: Feb. 19, 2013

(54) LIGHT MODULE FOR AN ILLUMINATION DEVICE

(75) Inventors: Florian Stade, Metzingen (DE); Benjamin Stauss, Reutlingen (DE); Michael Scholl, Gomaringen (DE)

(73) Assignee: Automotive Lighting Reutlingen GmbH (DE)

( * ) Notice: Subject to any disclaimer, the term of this patent is extended or adjusted under 35 U.S.C. 154(b) by 451 days.

(21) Appl. No.: 12/704,014

(22) Filed: Feb. 11, 2010

(65) Prior Publication Data

US 2010/0226144 A1 Sep. 9, 2010

(30) Foreign Application Priority Data

Feb. 13, 2009 (DE) ..... 10 2009 010 558

(51) Int. Cl.
*F21V 11/00* (2006.01)

(52) U.S. Cl. ..... 362/539; 362/520; 362/538

(58) Field of Classification Search ..... 362/459–549
See application file for complete search history.

(56) References Cited

U.S. PATENT DOCUMENTS

2008/0037270 A1* 2/2008 Kagiyama ..... 362/510
2008/0285297 A1* 11/2008 Ishida ..... 362/539

* cited by examiner

*Primary Examiner* — William Carter
(74) *Attorney, Agent, or Firm* — Donald R. Boys; Central Coast Patent Agency, Inc

(57) ABSTRACT

The present invention relates to a light module (10) for an illumination device, in particular for a headlight (1), of a motor vehicle. The light module (10) comprises at least one light source (18) for emitting light beams, at least one primary optical unit (20) for concentrating the emitted light beams, a diaphragm arrangement (22) in the beam path of the concentrated light beams, and at least one secondary optical unit (30) for imaging the light beams that have traveled past the diaphragm arrangement (22) onto a roadway in front of the motor vehicle in order to generate a desired light distribution. There is formed in the diaphragm arrangement (22) at least one opening (26) and/or cutout to which is assigned an optically active element (28), which deflects or attenuates at least a portion of the light beams passing through the opening (26) and/or cutout.

10 Claims, 3 Drawing Sheets

LIGHT MODULE FOR AN ILLUMINATION DEVICE

CROSS-REFERENCE TO RELATED DOCUMENTS

The present application claims priority to German patent application serial number 10 2009 010 558.1, which was filed on Feb. 13, 2009, which is incorporated herein in its entirety, at least by reference.

The present invention relates to a light module for a headlight of a motor vehicle. The light module comprises at least one light source for emitting light beams and at least one primary optical unit for concentrating the emitted light beams. The light module is designed for generating a screened light distribution on a roadway in front of the vehicle with a substantially horizontal bright-dark boundary.

The prior art discloses various light modules embodied as so-called projection modules for vehicle headlights which, by means of changeover can project different light distributions and—if the light distributions have a bright-dark boundary—bright-dark boundaries with different courses on to the road. The bright-dark boundary extends substantially horizontally and has a legally prescribed course in the individual countries or regions. Thus, a continuous horizontal course of the bright-dark boundary is customary in the USA. In Europe, the bright-dark boundary comprises two horizontal sections, wherein the section arranged on the vehicle's side of the road extends above the other section and a transition between the two sections has a 15° rise. In Japan a similar course of the bright-dark boundary is customary, there the transition between the two sections extending in stepped fashion. All these different bright-dark boundaries are referred to hereinafter as bright-dark boundaries with a substantially horizontal course.

The projection module comprises a light source, e.g. comprising at least one incandescent lamp, at least one gas discharge lamp and/or at least one semiconductor light source (LED). Particularly when LEDs are used, the light source for generating the light emitted by the illumination device usually comprises a plurality of LEDs. The LEDs can be arranged, mechanically fixed and electrically contact-connected on a semiconductor chip. The light emitted by the light source is concentrated by a primary optical unit. The primary optical unit can be embodied as at least one reflector or as at least one attachment optical unit which concentrates the light beams emitted by the light source by means of total reflection. A secondary optical unit, for example in the form of at least one projection lens, projects the light beam onto the roadway in front of the vehicle in order to generate a predetermined light distribution (e.g. high-beam light). A diaphragm arrangement can be arranged between the primary optical unit and the secondary optical unit, said diaphragm arrangement shading part of the concentrated light and thus serving for generating a light distribution with a bright-dark boundary (e.g. fog light or low-beam light). The light distribution generated by the illumination device on the road in front of the vehicle can be realized by a single light module but also by the interaction of a plurality of light modules of the same or different illumination devices, wherein the different light modules can each per se generate the same or different light distributions which are then superimposed to form the predetermined light distribution of the illumination device. Particularly in the case of LED headlights, the total light distribution is generally formed by the superimposition of the individual light distributions of a plurality of light modules of the headlight.

The different light functions or courses of the bright-dark boundary which can be obtained by a projection module can be realized by a motor-adjustable or electromagnetically adjustable diaphragm arrangement, which are arranged in the beam path of the light beams concentrated by the primary optical unit. The diaphragm arrangement can comprise a plurality of diaphragm elements which are movable relative to one another in the diaphragm plane and which interact in such a way that the resulting upper edge of the diaphragm arrangement, said upper edge forming the bright-dark boundary, is formed from a superimposition of the upper edges of the individual diaphragm elements. Therefore, the course of the resulting upper edge of the diaphragm arrangement and thus also of the bright-dark boundary can be varied by the movement of the individual diaphragm elements relative to one another.

The different light distributions are therefore realized by a targeted shading of more or less of the light concentrated by a primary optical unit. In the resulting light distribution on the roadway, the diaphragm arrangement arranged in the beam path forms a substantially dark region above the bright-dark boundary.

In the case of light distributions of headlights with a horizontal bright-dark boundary, an—albeit small—amount of light must also pass into the region of the light distribution above the bright-dark boundary in order, when visibility is poor, by way of example, to be able to better recognize traffic signs at the side of the road. In the region above the bright-dark boundary, in accordance with the legal regulations (e.g. ECE Regulation in Europe), on a measurement screen arranged at a predetermined distance (e.g. 75 m) from the headlight, specific measurement points (e.g. B50L) are even defined at which predetermined minimum or maximum values of the illuminance must be present or must not be exceeded or undershot.

The prior art discloses various possibilities, in the case of headlights which generate a screened light distribution with a substantially horizontal bright-dark boundary, for imaging a specific quantity of light in a targeted manner at defined locations above the bright-dark boundary or for increasing the illuminance there. DE 199 47 876 A1 discloses a headlight having a light module operating according to the reflection principle, in which, during the generation of a screened light distribution with a horizontal bright-dark boundary, by means of a specifically designed reflection element, a partial light beam is directed in a targeted manner into a partial region of the light distribution above the bright-dark boundary in order to illuminate the partial region above the bright-dark boundary in a targeted manner. However, the procedure described in said document for the targeted illumination of a partial region of the light distribution above the bright-dark boundary cannot be employed, or can be employed only with very great outlay, for light modules realized according to the projection system. Moreover, the configuration and use of an additional reflection element is very complex and expensive.

Proceeding from the prior art described, the present invention is based on the object of configuring and developing a light module for a motor vehicle headlight to the effect that the illuminance in a partial region of a screened light distribution of the headlight above the bright-dark boundary can be increased in a targeted manner by means of a simple and thus inexpensive measure.

In order to achieve this object, proceeding from the light module of the type mentioned in the introduction, it is proposed that the light module is embodied as a projection module and has a diaphragm arrangement in the beam path of the light beams concentrated by the primary optical unit, and at least one secondary optical unit for imaging the light beams that have traveled past the diaphragm arrangement onto the roadway in front of the motor vehicle in order to generate the screened light distribution, and that there is formed in the diaphragm arrangement at least one opening and/or cutout to which is assigned an optically active element, which, during the generation of the screened light distribution, deflects or attenuates at least a portion of the light beams passing through the opening and/or cutout.

The light module according to the invention is embodied as a projection module. It is designed for generating a screened light distribution with a substantially horizontal bright-dark boundary, e.g. of a low-beam light, of an ordinary road light, of an expressway light, of a cornering light or of a fog light. In contrast to conventional projection modules having diaphragms completely opaque to light, the diaphragm arrangement of the light module according to the invention has at least one cutout at the edge and/or an opening in the inner part of the diaphragm arrangement through which part of the light which is emitted by the light source, concentrated by the primary optical unit and impinges on the diaphragm arrangement and is visible to the human eye can pass. An optically active element is assigned to the cutout and/or opening of the diaphragm arrangement, such that the light passing through can be utilized in a targeted manner for variation and improvement of the light distribution. In particular, the optically active element deflects the light that has passed through the cutout and/or opening in a targeted manner into a partial region of the light distribution where a higher illuminance and/or diffusion of the light that has traveled there is desired. In this way, it is possible, for example, to realize a fluid transition from the shaded region to the illuminated region of the light distribution, that is to say a fluid bright-dark boundary, which is perceived as particularly pleasant by the driver of the vehicle.

The light module according to the invention has at least one light source embodied in any desired manner. In particular, the light source comprises an incandescent lamp, a gas discharge lamp or an LED. The at least one concentrating primary optical unit can comprise a reflector or an attachment optical unit having totally reflecting properties. The secondary optical unit can have one or more projection lenses.

The present invention is based on the concept of brightening that region of the light distribution which is shaded by the diaphragm arrangement, by virtue of the fact that the diaphragm arrangement is made transmissive in a targeted manner to a portion of the shielded light beams as a result of the formation of the openings and/or cutouts in the diaphragm arrangement. In this case, the assigned optically active element attenuates the brightness of the light beams that pass through, in order that the region above the bright-dark boundary is not illuminated too brightly and in order that oncoming road users or road users traveling ahead are not thereby dazzled. The minimal illumination of the shaded region of the light distribution can thus be realized in a simple and thus cost-effective manner. The solution according to the invention is not visible externally to an observer of the headlight. Consequently, the design of new headlights is not adversely affected by the invention either.

Features which are important to the invention will furthermore be found in the following description and in the drawing, where the features may be important to the invention both by themselves and in different combinations, without this being explicitly pointed out in each case. Advantageous developments will be found in the dependent claims.

In this case, it is advantageous if the optically active element deflects light beams impinging on the diaphragm arrangement in the region of the opening and/or cutout in such a way that the deflected light beams, after passing through the secondary optical unit, illuminate a predetermined partial region of the light distribution above the bright-dark boundary. This results in an apportioned illumination above the bright-dark boundary in the case of the low-beam light for attaining sufficiently large overhead values such as are required e.g. in the relevant ECE or SAE regulations for motor vehicle headlights (e.g. ECE R123).

The optically active element can be embodied as a spherical or aspherical lens. The lens should bring about deflection and/or diffusion of the light beams that pass through. Diffusion can be obtained either by means of a diverging lens or by means of a converging lens (but then only downstream of the focal point of the lens). By way of example, a biconvex, planoconvex, concavo-convex, biconcave, planoconcave or convexo-concave configuration or a meniscus form of the lens is conceivable. The entrance surface and/or the exit surface of the lens can be provided with diffusing elements at least in regions. If the illumination device has a secondary optical unit, the diffusing and/or deflecting effect is preferably obtained in the interplay between the optically active element and the secondary optical unit.

It is advantageous if the optically active element is embodied as a diffusing optical unit, in particular a lens. The diffusing optical unit prevents the light beams which pass through the openings and/or cutouts of the diaphragm arrangement from illuminating undesirable punctiform partial regions above the bright-dark boundary. The diffusion of the light beams passing through the openings and/or cutouts improves the homogeneity of the resulting light distribution. Punctiform partial regions of the light distribution with particularly high or particularly low brightness could be a source of irritation for the driver of the motor vehicle. Punctiform partial regions of the light distribution with particularly high brightness could subjectively bring about a particularly high degree of dazzle for drivers of oncoming vehicles or vehicles traveling ahead. Punctiform illuminance peaks in the shaded region above the bright-dark boundary can be flattened out by the diffusion of the light, such that the legal requirements are satisfied.

The at least one diffusing optical unit makes it possible to realize a fluid transition from the shaded region to the illuminated region of the light distribution (fluid bright-dark boundary) which is subjectively perceived as pleasant by the driver of the vehicle.

As an alternative, the optically active element can simply attenuate the light beams which impinge on the diaphragm arrangement in the region of the opening and/or cutout and are imaged above the bright-dark boundary. For this purpose, the optically active element could be embodied in semitransparent fashion, for example, such that only a portion of the impinging light beams can pass through the optically active element. This is possible by means of subsequent coating by vapor deposition, lacquering, roughening or partial blackening of an originally light-transmissive optically active element. By this means, too, the required minimal illumination of the shaded region above the bright-dark boundary can be achieved without high costs. What is crucial in this embodiment is that the diaphragm arrangement per se is embodied in light-opaque fashion and is embodied such that it is at least partly light-transmissive only in very few partial regions. The proportion of the completely and/or partly light-transmissive area is preferably less than 10% relative to the total area of the diaphragm arrangement.

It is also possible for the diaphragm arrangement to have at least one opening or cutout which forms at least one light channel tapering conically in the light exit direction, which light channel selects light beams impinging on the diaphragm arrangement from specific angle ranges. In this case, the light channel is preferably configured in such a way that it permits only those light beams which impinge on the diaphragm arrangement at a specific predetermined angle to pass through. Light beams which impinge on the diaphragm arrangement from angles other than the predetermined angles are reflected out of the opening again on account of the conical form of said opening or are absorbed by the inner wall of the opening. The inner walls of the light channel can have a reflective effect in this case. As a result of the conical embodiment and/or the reflective inner walls, a portion of the light impinging on the diaphragm arrangement is preshaped and subsequently deflected, diffused or attenuated by the optically active element in any desired manner in relation to a partial region of the light distribution above and/or on the bright-dark boundary.

The optically active element can be an integral component part of the diaphragm arrangement. This means a low manufacturing and assembly outlay. The one-piece embodiment of diaphragm and optically active element can be produced e.g. by means of a two-component method (2c method). The optically active element can, of course, also be embodied as a separate component which is positioned downstream or upstream of the diaphragm arrangement in the light exit direction or even in the cutout and/or the opening and is fixed to the diaphragm arrangement in any desired manner (e.g. adhesive bonding, clipping, welding, screwing, etc.).

The multipartite embodiment of diaphragm arrangement and optically active element increases the flexibility of the entire diaphragm arrangement since, as required, the optically active element, e.g. in the context of a modular construction, can be replaced by a corresponding element having other optical properties. In this way, it is possible for the light distribution obtained by an illumination device to be adapted to the different legal requirements in a rapid and simple manner. A headlight designed for ECE territory can thus be adapted to the SAE regulations simply by the optical element used in ECE territory being replaced by a different optical element, which diffuses or deflects the light passing through the openings and/or cutouts in the diaphragm arrangement in such a way that the resulting light distribution satisfies the relevant SAE regulations, particularly with regard to the permissible maximum illuminance values above the bright-dark boundary.

The diaphragm arrangement is advantageously produced from a plastic material. Plastic can preferably be used if LEDs are used as the light source, since the LED light is significantly colder (that is to say has a smaller IR component) than the light from incandescent lamps or gas discharge lamps. Moreover, plastic affords an advantage with regard to simple and inexpensive production. In addition, plastic is lighter in terms of weight than metal, for example, such that, when the light distribution of the light module is changed over by the movement of the diaphragm, less mass has to be moved and the light module overall is lighter than previous light modules. The diaphragm arrangement could be produced by means of a cost-effective injection-molding method, by way of example. If the diaphragm arrangement is produced from plastic, it is appropriate for the optically active element also to be produced from plastic (instead of glass or some other suitable material). This holds true particularly when the optically active element is an integral component part of the diaphragm arrangement and is produced at the same time as the latter. Of course, the optically active element can also be produced from glass or some other suitable material.

BRIEF DESCRIPTION OF THE FIGURES

An exemplary embodiment of the invention is explained by way of example below with reference to the figures, in which.

DETAILED DESCRIPTION

The invention relates to a light module for a headlight of a motor vehicle, which light module is embodied as a projection module. At least one light distribution for low-beam light with a substantially horizontally extending bright-dark boundary can be generated by means of such a projection module. In addition, the light module can generate further light distributions, e.g. a light distribution for high-beam light.

In order to change over between low-beam light and high-beam light, the low-beam light function is generally realized, inter alia, by means of an adjustable diaphragm arrangement arranged in a diaphragm plane of the projection module. In this case, the diaphragm arrangement shades light from a light source in the projection module that is emitted in part during the realization of low-beam light. In this case, an edge of the diaphragm arrangement that points toward the center of the projection module forms a substantially horizontal bright-dark boundary on the roadway in front of the vehicle, in order not to dazzle oncoming vehicles. The precise course of the bright-dark boundary is subject to different regulations in the individual countries and has different configurations, particularly when illuminating a roadside.

Figure 1:
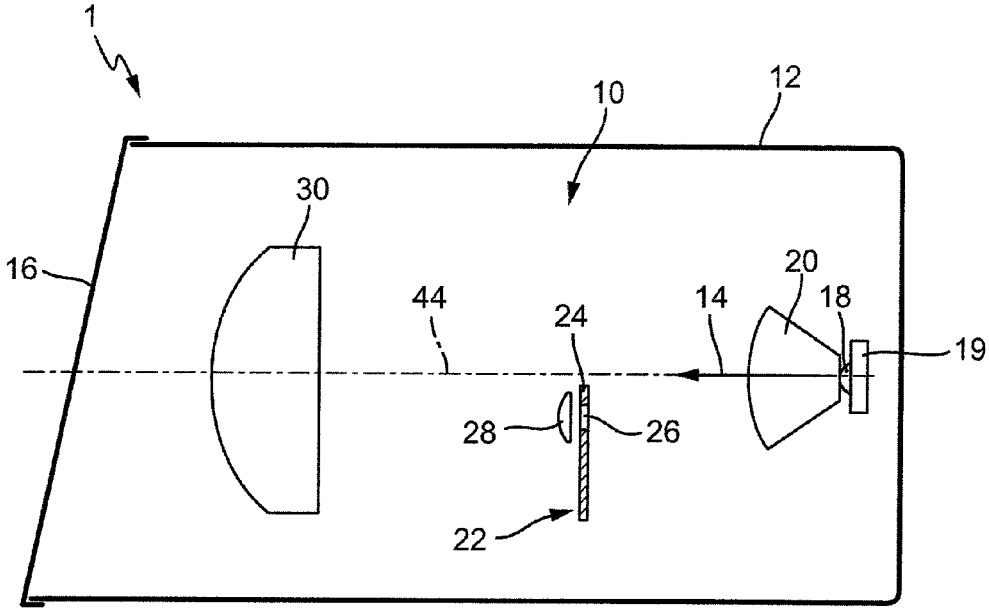
FIG. 1 shows a schematic illustration of a light module according to the invention in a housing in vertical section.

FIG. 1 shows a motor vehicle headlight in accordance with one preferred embodiment of the invention. The headlight is designated in its entirety by the reference symbol 1. The headlight 1 comprises a housing 12 having a light exit opening in the light exit direction 14, said light exit opening being closed off by a light-transmissive covering sheet 16. The covering sheet 16 can be embodied with optically active elements (e.g. prisms, cylindrical lenses, etc.) or without the latter as a so-called clear glass sheet. A projection module 10 for generating low-beam light and high-beam light is arranged in the interior of the housing 12. It goes without saying that further light modules for generating other light functions, such as e.g. fog light, static cornering light, position light, daytime running light or indicator light, can additionally be arranged in the housing.

The light module 10 is embodied as a projection module and comprises at least one light source 18, only one light source 18 embodied as a semiconductor light source (LED) being illustrated by way of example in the exemplary embodiment from FIG. 1. The LED 18 is arranged on a circuit board 19 (so-called chip) and mechanically fixed and electrically contact-connected thereon. It goes without saying that the light module 10 can also have a plurality of LEDs combined to form an LED array as the light source. The light emitted by the light source 18 is concentrated by means of a primary optical unit 20. In the exemplary embodiment illustrated, the primary optical unit 20 is embodied as an attachment optical unit having totally reflecting properties. It goes without saying that the primary optical unit 20 can also be embodied as a reflector, e.g. as an ellipsoid reflector, particularly when an incandescent lamp or a gas discharge lamp is used as light sources. In an arrangement of a plurality of LEDs 18, each LED 18 can have a dedicated attachment optical unit 20, but it is also possible for a plurality of LEDs 18 to be assigned to a common attachment optical unit 20.

An optical axis of the light module 10 is designated by the reference symbol 44. In the light exit direction 14, the projection module 10 has downstream of the primary optical unit 20 a diaphragm arrangement 22 configured in substantially planar and level fashion. The diaphragm arrangement 22 is preferably produced from plastic and is embodied in one piece. However, in order to extend its functionality, it can also consist of a plurality of diaphragm elements which are substantially arranged in the diaphragm plane and which are movable relative to one another. The diaphragm elements interact in such a way that a resulting upper edge 24 of the diaphragm arrangement 22, which upper edge forms the bright-dark boundary, is formed from a superimposition of the upper edges of the individual diaphragm elements. Therefore, the course of the resulting upper edge 24 of the diaphragm arrangement 22 and thus also of the bright-dark boundary of the resulting light distribution can be varied by the movement of the individual diaphragm elements relative to one another.

In order to change over between low-beam light and high-beam light, the diaphragm arrangement 22 can be moved by electric motor or electromagnetically into the beam path of the light beams emitted by the light source 18 and concentrated by the primary optical unit (for low-beam light; cf. the position in FIGS. 1 and 2) and out of said beam path again (for high-beam light). In the position of the diaphragm arrangement 22 for low-beam light, the upper edge 24 of the diaphragm device 22 is imaged as the bright-dark boundary of the resulting light distribution of the headlight on a roadway in front of the vehicle.

In conventional projection modules, the diaphragm arrangement 22 is usually embodied such that it is completely light-opaque. Therefore, apart from small portions of stray light, practically no light passes into the region of the light distribution above the bright-dark boundary. The present invention now makes it possible to direct in a targeted manner a desired quantity of light to one or more desired partial regions of the light distribution above or on the bright-dark boundary.

For this purpose, the diaphragm arrangement 22 has an opening 26, to which an optically active element 28 is assigned. In the exemplary embodiment illustrated, said element is embodied as a planoconvex lens 28 covering the opening 26. It goes without saying that the optically active element 28 can also be embodied as a planoconcave lens or as a differently configured lens.

Figure 2:
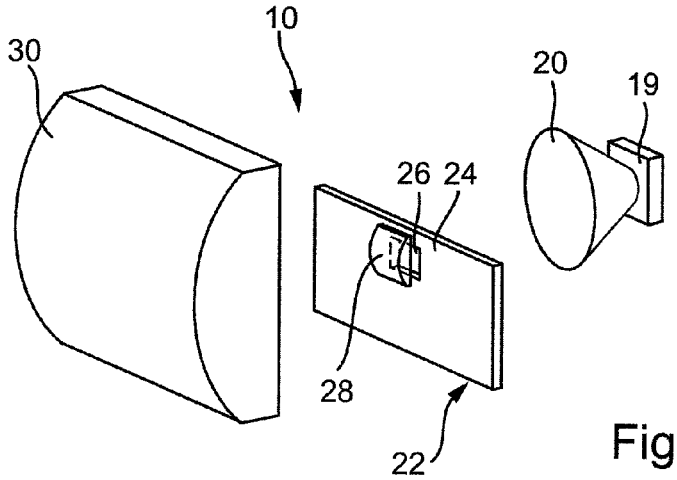
FIG. 2 shows a perspective illustration of the light module from FIG. 1.

Moreover, it is conceivable for the optical element 28 to cover only part of the opening 26 or a plurality of openings. The lens 28 preferably has light-diffusing properties and is produced from plastic or glass. In this case, the lens 28 can be an integral component part of the diaphragm arrangement 22. However, it can also—as illustrated in FIGS. 1 and 2—be configured as a separate component that is fixed to the diaphragm 22. For diffusing the light that has passed through the opening 26, it is also possible to use, instead of the diffusing lens 28, an initially light-transmissive optically active element that is subsequently coated by vapor deposition, lacquered, roughened or partly blackened in order to obtain a light-diffusing property of the optical element 28.

Instead of or in addition to the opening 26 formed on the surface of the diaphragm arrangement 22, at least one cutout formed at the edge of the diaphragm arrangement 22 can also be provided. Instead of the one opening 26, a plurality of openings 26 and/or cutouts can also be formed in the diaphragm arrangement 22.

Figure 3A:
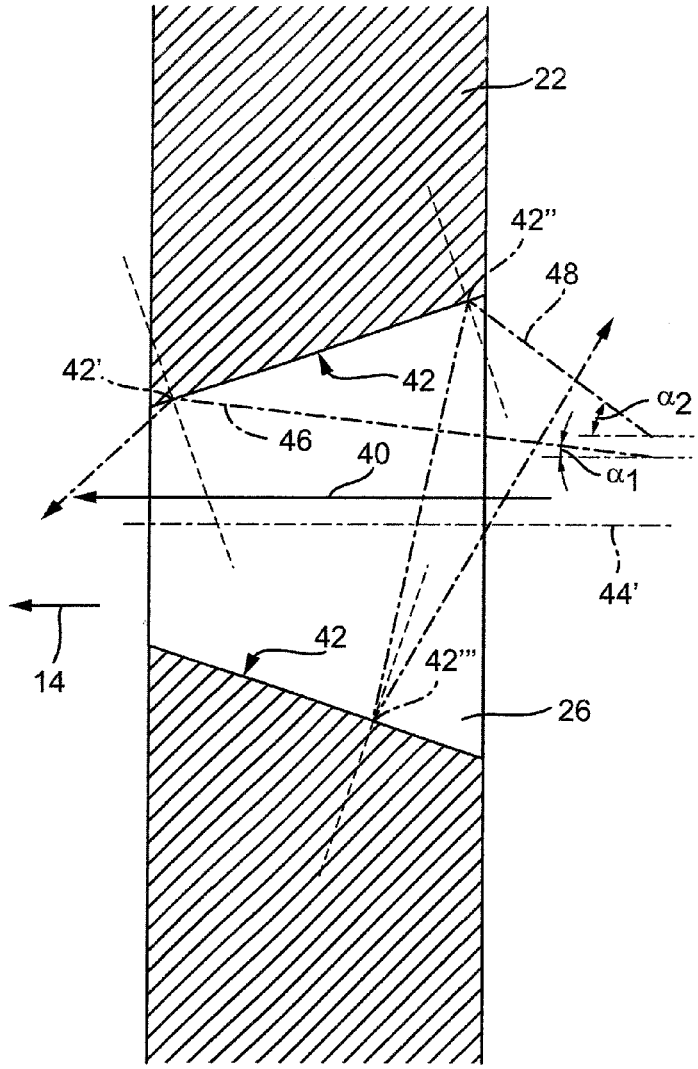
FIG. 3*a* shows a cross section through the diaphragm arrangement of the light module according to the invention in accordance with a first preferred embodiment.

In an embodiment illustrated in FIG. 3*a*, the opening 26 can form a light channel in the diaphragm arrangement 22, which light channel narrows, that is to say tapers conically, in the light exit direction 14. This has the effect that light beams that impinge in the opening 26 precisely in the light exit direction 14, such as the light beam 40, by way of example, is transmitted through the opening 26 without touching the inner wall 42 of the opening 26. A light beam that impinges in the opening 26 at a relatively small angle $\alpha 1$ relative to the optical axis 44 (an axis 44' parallel to the optical axis 44 is depicted in the figure) of the light module 10, such as the light beam 46, for example, is transmitted through the opening 26 with a reflection at the location 42' of the inner wall 42 of said opening. Light beams that impinge in the opening 26 at a larger angle $\alpha 2$ of incidence, such as the light beam 48, by way of example, are reflected out of the opening 26 again after at least two reflections at the locations 42" and 42'" of the inner wall 42 of said opening. The selective behavior of the opening 26 with respect to angle of incidence requires an at least partly reflective inner wall 42 of the opening 26. As an alternative, the inner wall 42 can also be embodied in light-absorbent fashion, such that light beams can pass through the opening 26 only without touching the inner wall 42.

Figure 3B:
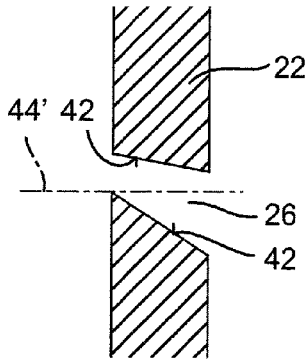
FIG. 3*b* shows a cross section through the diaphragm arrangement of the light module according to the invention in accordance with a second preferred embodiment.

A further possible configuration of the opening 26 in the diaphragm arrangement 22 is illustrated in FIG. 3*b*. In the exemplary embodiment shown there as well, the above-described selective behavior with respect to angle of incidence can arise as a result of the corresponding configuration of the inner wall 42 of the opening 26.

Downstream of the diaphragm arrangement 22 in the light exit direction 14, the projection module 10 comprises a secondary optical unit 30, which is embodied as a projection lens in the exemplary embodiment illustrated in FIGS. 1 and 2. For light-technological reasons, one or both surfaces of the lens 30 can be provided with regular or irregular structures, including so-called microstructures. The lens 30 is preferably embodied as a planoconvex lens, wherein the convex side is preferably embodied in aspherical fashion. In the case of a corresponding design, a meniscus lens may also be advantageous. The projection lens 30 is preferably arranged such that its focal point is arranged in the diaphragm plane of the diaphragm arrangement 22. It serves for imaging the radiation beam from the light source 18 on the roadway in front of the motor vehicle. In the case of low-beam light, an illuminated region and a shaded region are imaged on the roadway, and the bright-dark boundary forms the transition between the two regions.

Figure 4:
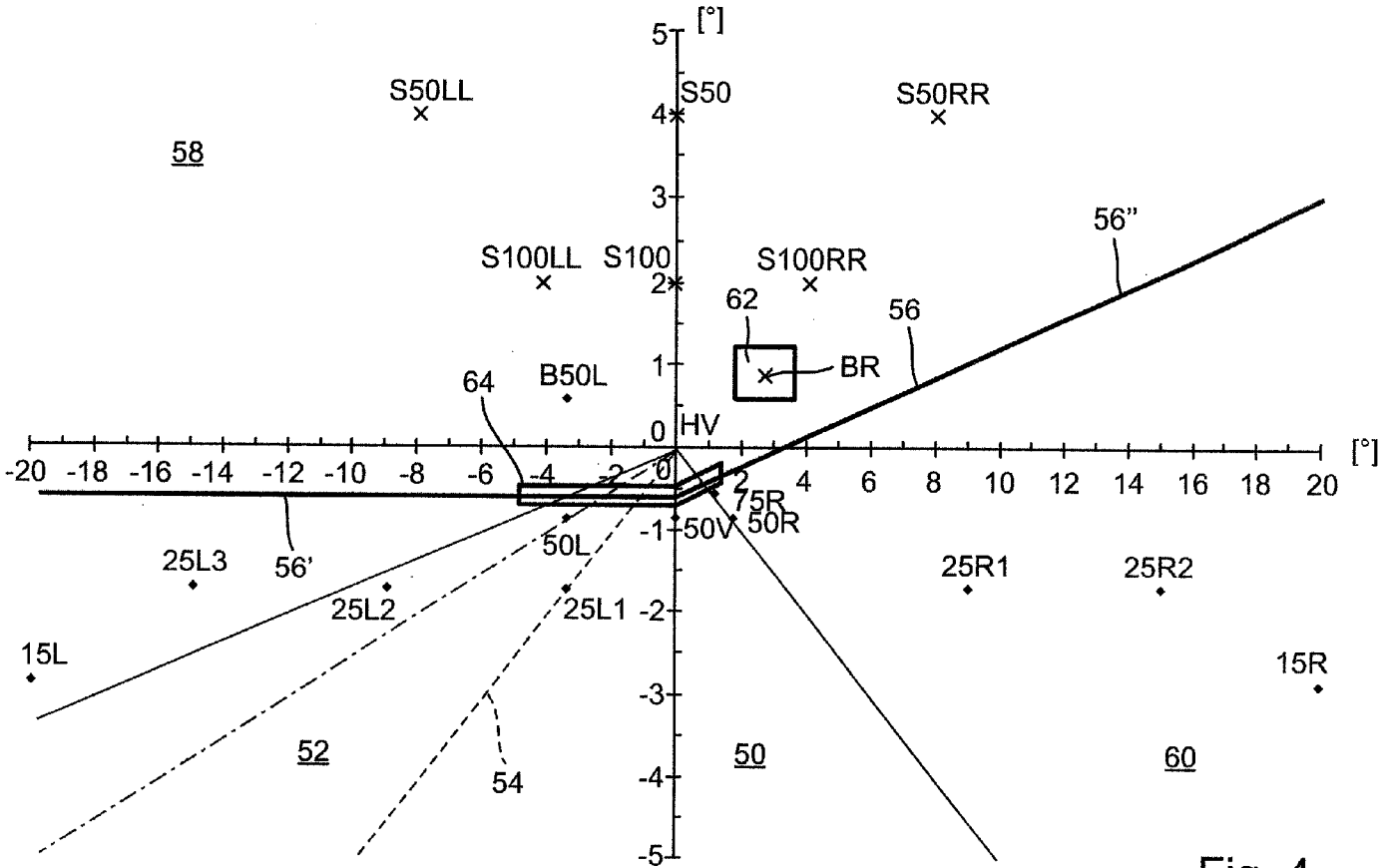
FIG. 4 shows a light distribution which can be obtained with the light module according to the invention.

A light distribution for low-beam light which can be obtained by means of the light module 10 according to the invention is illustrated by way of example in FIG. 4 on the basis of a measurement screen arranged in front of the headlight 1. The measurement screen comprises a horizontal axis HH and also a vertical axis VV, which intersect at the point HV. A roadway in front of the vehicle is furthermore symbolized on the measurement screen, the vehicle's section of the roadway being designated by the reference symbol 50, an oncoming section of the roadway being designated by the reference symbol 52 and a center line between the two sections of the roadway 50 and 52 being designated by 54. The roadway disappears at the point HV on the horizon. The light distribution for low-beam light illustrated by way of example has a substantially horizontal so-called asymmetrical bright-dark boundary 56 in accordance with the ECE regulations that are in force in Europe. The bright-dark boundary 56 comprises a horizontal section 56' on the oncoming section 52 of the roadway, which horizontal section merges into a rising section 56" approximately at the vertical axis VV. The rise of the section 56" is approximately 15°. It would also be conceivable for the bright-dark boundary 56 to comprise exclusively one substantially horizontally extending section, as is required e.g. in the USA. Furthermore, it would be conceivable for the bright-dark boundary 56 to have two horizontal sections of different heights, wherein the section on the vehicle's side of the road is higher than the section on the oncoming side of the road, and wherein the two sections are connected to one another by means of a step, as is required e.g. in Japan. The region 58 above the bright-dark boundary 56 is referred to as shaded dazzle region and the region 60 below said bright-dark boundary is referred to as the illumination region.

FIG. 4 depicts a plurality of measurement points in accordance with ECE R123 at which the overhead values of the light distribution must not exceed predetermined maximum values and must attain predetermined minimum values. These are the points S100LL, S100, S100RR and BR, for example. With the aid of the diaphragm arrangement 22 of the light module 10 according to the invention that is embodied in the manner proposed, light impinging on the diaphragm arrangement 22 can be deflected through the opening 26 and by means of the optically active element 28 into any desired partial region above or on the bright-dark boundary 56.

FIG. 4 depicts a first partial region 62, which brings about better illumination of the roadside relating to the vehicle (here the right roadside), in particular better illumination of traffic signs, if additional light is applied to it through the opening 26 and by means of the optically active element 28. The measurement point BR also lies in the region 62. As an alternative or in addition, it is also conceivable for the optically active element 28 to deflect light that has passed through the opening 26 into a region 64 on the bright-dark boundary 56. The optical element 28 diffuses the light passing through and also deflects it under certain circumstances. The light that has passed through the optical element 28 is then projected by the projection lens 30 into the region 64, where it appears as diffused light. In this way, at least in regions, in the illustrated exemplary embodiment in the region of the roadway 50, 52, it is possible to realize an unsharp, soft or else fluid bright-dark boundary 56. The fluid bright-dark boundary in the region 64 is represented by a plurality of lines parallel to the original bright-dark boundary 56 in FIG. 4.

The invention claimed is:

1. A light module for a headlight of a motor vehicle, the light module comprising at least one light source for emitting light beams and at least one primary optical unit for concentrating the emitted light beams, the light module-being designed for generating a screened light distribution on a roadway in front of the vehicle with a substantially horizontal bright-dark boundary wherein the light module is embodied as a projection module and has a diaphragm arrangement in the beam path of the light beams concentrated by the primary optical unit, and at least one secondary optical unit for imaging the light beams that have traveled past the diaphragm arrangement onto the roadway in front of the motor vehicle in order to generate the screened light distribution, and wherein there is formed in the diaphragm arrangement at least one opening and/or cutout to which is assigned an optically active element, which, during the generation of the screened light distribution, deflects or attenuates at least a portion of the light beams passing through the opening and/or cutout and deflects light beams impinging on the diaphragm arrangement in the region of the opening and/or cutout in such a way that the deflected light beams, after passing through the secondary optical unit, illuminate a predetermined region of the light distribution above the bright-dark boundary.

2. The light module as claimed in claim 1, wherein the optically active element is embodied as a diffusing optical unit, in particular as a lens.

3. The light module as claimed in claim 1, wherein the optically active element attenuates light beams impinging on the diaphragm arrangement in the region of the opening and/or cutout.

4. The light module as claimed in claim 1, wherein the diaphragm arrangement forms an opening and/or cutout which forms a light channel tapering conically in the light exit direction, which light channel selects light beams impinging on the diaphragm arrangement from specific angle ranges.

5. The light module as claimed in claim 1, wherein the optically active element is an integral component part of the diaphragm arrangement.

6. The light module as claimed in claim 1, wherein the optical element is embodied as a separate part and is fixed to the diaphragm arrangement.

7. The light module as claimed claim 1, wherein the at least one light source comprises a semiconductor light source.

8. The light module as claimed in claim 1, wherein the diaphragm arrangement is produced from a plastic material.

9. The light module as claimed in claim 1, wherein the optically active element is produced from a plastic material or glass.

10. A motor vehicle headlight comprising at least one light module having at least one light source for emitting light beams and at least one primary optical unit for concentrating the emitted light beams, wherein the at least one light module is designed for generating a screened light distribution on a roadway in front of the vehicle with a substantially horizontal bright-dark boundary, wherein the at least one light module has all the features of claim 1.

* * * * *